US007469986B2

(12) United States Patent
Chan

(10) Patent No.: US 7,469,986 B2
(45) Date of Patent: Dec. 30, 2008

(54) MARKING MATERIAL CARTRIDGE WITH PROCESSOR HAVING CONFIGURABLE LOGIC

(75) Inventor: Alan K. Chan, Fairport, NY (US)

(73) Assignee: Nu-Kote International, Inc., Franklin, TN (US)

( * ) Notice: Subject to any disclaimer, the term of this patent is extended or adjusted under 35 U.S.C. 154(b) by 404 days.

(21) Appl. No.: 11/323,541

(22) Filed: Dec. 30, 2005

(65) Prior Publication Data

US 2007/0153066 A1 Jul. 5, 2007

(51) Int. Cl.
*B41J 29/393* (2006.01)
*B41J 2/175* (2006.01)

(52) U.S. Cl. ..... 347/19; 347/86

(58) Field of Classification Search ..... 347/5, 347/19, 86, 87; 358/1.15, 1.17; 399/12, 399/13, 24, 25, 27

See application file for complete search history.

(56) References Cited

U.S. PATENT DOCUMENTS 5,049,898 A * 9/1991 Arthur et al. ..... 347/19
5,610,635 A 3/1997 Murray et al.
5,797,060 A 8/1998 Thompson
5,812,156 A * 9/1998 Bullock et al. ..... 347/19
6,193,349 B1 * 2/2001 Cornell et al. ..... 347/18
6,227,643 B1 * 5/2001 Purcell et al. ..... 347/19
6,315,379 B1 * 11/2001 Adams et al. ..... 347/14
6,371,586 B1 * 4/2002 Saruta ..... 347/7
6,507,213 B1 * 1/2003 Dangat ..... 326/38
7,046,570 B1 * 5/2006 Hubbard ..... 365/225.7
7,164,491 B2 * 1/2007 Hasegawa ..... 358/1.18
7,213,897 B2 5/2007 Kosugi
7,344,214 B2 * 3/2008 Chan ..... 347/7
2003/0151771 A1 8/2003 Hasegawa

OTHER PUBLICATIONS

Actel Integrates Analog Peripherals, Flash Memory and FPGA Fabric in a Monolithic Programmable System Chip; Internet Source: http://www.soccentral.com; Date: Dec. 20, 2005; pp. 1.
FPGA-Centric Computing Architecture; Internet Source: http://www.soccentral.com; Date: Dec. 20, 2005; pp. 2.
Software-Configurable Processors on the Rise; Internet Source: http://soccentral.com; Date: Dec. 20, 2005; pp. 6.
PLD Definition; Internet Source: http://www.pcmag.com; Date: Dec. 20, 2005; pp. 6.

* cited by examiner

*Primary Examiner*—Anh T. N. Vo
(74) *Attorney, Agent, or Firm*—Fay Sharpe LLP

(57) ABSTRACT

A processor is provided for use with a marking material cartridge the processor having configurable logic for configuring the processor for use with an associated printing device. A print cartridge includes a housing defining a chamber for storing a marking material therein and a circuit on the housing. The circuit includes a memory portion storing data related to the marking material, an interface portion in operative communication with the associated printing device for communicating therewith, and a configurable execution unit including a network of gates which are programmable by first set of instruction primitives received into the circuit to define a first set of operation instructions executable by the execution unit during operation of the print cartridge of the associated printing device. A method is provided for adapting a print cartridge for use with a printer including providing a processor having configurable logic on the print cartridge, and configuring the configurable logic of the processor for operative compatibility with the printer. In one form, the configurable logic processor is a programmable logic device which is configured by opening fusible links between logical gates contained in the programmable logic device.

10 Claims, 4 Drawing Sheets

MARKING MATERIAL CARTRIDGE WITH PROCESSOR HAVING CONFIGURABLE LOGIC

BACKGROUND

The present exemplary embodiments relate to replaceable consumables holding marking material and, more particularly, to replaceable consumables holding marking material and including processors having internal logic gates which are configurable to adapt the cartridge for interaction and use with a wide variety of marking machines such as printers and the like. The present exemplary embodiments of circuits with processors having configurable logic find particular application in conjunction with ink jet cartridges and toner cartridges, and will be described with particular reference thereto. However, it is to be appreciated that the present exemplary embodiments are also amenable to other applications such as, for example, anywhere replaceable consumables are used together with devices or systems dispensing consumable materials during manufacturing operations or any other industrial, commercial or clinical or medical processing operation.

In connection with printing words and images on paper, it is important for proper operation of the printing device that compatible replaceable consumables are used. More particularly, many printers are developed using hardware and the like designed to operate with particular ink or toner formulations. Also, mechanisms provided in the printer for even, smooth, and efficient delivery of marking material to the printhead portions of the printer require corresponding structures on the replaceable consumables. These may include specialized ports or valving in ink cartridges or gears and other drive mechanisms in toner cartridges for example.

Thus, there may be a legitimate need in the art for printing devices to interrogate replaceable consumables in the form of ink cartridges and/or toner cartridges for information relating to compatibility of the cartridges and their contents with the printing device. Printheads on some ink jet printers become destroyed if printing operations are continued beyond the quantity of ink contained within the replaceable cartridge. Accordingly, the quantity of marking material contained in the replaceable consumable is, at times, useful information.

Other information relating to the marking material might be important as well such as information relating to ink or toner formulations. In some cases, various electrical and mechanical parameters are determined internal to the printer based upon information relating to properties of the marking material. Examples include pulse width and voltage levels for firing ink jet nozzles based upon certain parameters of the ink marking material contained within the consumable cartridge. Cartridge manufacturers can accommodate new ink formulations in old printers by simply providing updated ink parameters data in the electronics carried on the cartridge.

Accordingly, for various business and technical reasons, original equipment manufacturers OEMs have provided electronics on replaceable consumables. Strategies with regard to implementation have included vastly different solutions. At one extreme, manufacturers have adopted application specific integrated circuit (ASIC) devices to carry information on the consumable cartridge. Others have adopted a universal approach by providing programmable microcontroller units (MCU) electronics on the cartridges.

ASICs include memory portions and read and write controllers adapted to communicate data between the associated printer and the memory portion of the cartridges. Ink quantity information, date of manufacture, ink quality and manufacturer information may be included in the memory portion of the ASIC. The ASIC is selectively interrogated by the printer for providing information to the printer. Also, as ink is consumed by the printer, the ink quantity information is selectively updated by writing data to the ASIC.

Those skilled in the art will appreciate that ASIC devices have a large initial cost in non-recurring engineering. ASIC design is inflexible and, once set, cannot be easily modified without incurring additional expenses. It is difficult for original equipment manufacturers to extend a single ASIC design across multiple cartridge applications because each ASIC design is typically specific to a particular cartridge type. Any changes in the cartridge specification such as changes in ink capacity, ink performance parameters, and the like cannot be accommodated without a redesign of the ASIC. These changes may become necessary in order to take advantage of new ink technologies for example or when safety or health compliance concerns affect existing ink technologies.

A more general solution has been proposed in the form of the MCU technology which typically includes a general purpose processor, a memory portion, a read and write controller and a fixed internal instruction set which can be utilized by the processor by constructing a written program for writing data to the memory portion and for communicating the data between the replaceable consumable and the printing device.

The processor in a typical MCU includes a set of preconfigured instructions to execute a predetermined set of instructions in the form of op codes. To reduce costs and increase speed, reduced instruction set cartridges (RISC) have been developed. The op code set provides basic instructions for processing the ink cartridge data received from the printer and for receiving cartridge data between the internal memory portion and the associated printing device as needed to support printing operation.

One disadvantage of the MCU/RISC technology is that the processor is only capable of executing op codes provided for by the MCU/RISC vendor. Therefore, the MCU operation cannot be optimized by the cartridge vendor to provide or perform special data operations. At times, the software in the MCU will be unable to keep pace with the timing required by the associated printer. The op codes and predetermined instruction set regardless of the on-board program may not be able to execute at a rate sufficient to keep pace with the printer communication interface protocol leading to a printer fault or a cartridge malfunction. Although the program can be changed to adapt MCU to changes in the cartridges, the cartridge vendor is constrained to program the MCU with the limited op code set provided from the vendor. In addition to the above, MCU/RISC technology is relatively expensive because, as noted above, the technology proposes a general solution for all applications rather than a specific solution narrowly tailored to specific printer types or product lines.

Therefore, there is a need in the industry for a replaceable consumable in the form of ink jet or toner cartridges carrying electronics including programmable logic devices which can be easily programmed after fabrication of the device but without the constraints of predefined op codes. A PLD, unlike an ASIC, can be programmed after it is manufactured. Also, a PLD can be programmed using any form of logic as desired unlike the MCU/RISC technology which relies upon predefined internal logic and op codes.

BRIEF DESCRIPTION

In accordance with one aspect of the present exemplary embodiment, a replaceable consumable in the form of a print cartridge includes a housing adapted to hold marking materials and a programmable logic device operative coupled with the housing.

In accordance with a further aspect of the embodiment, the programmable logic device is an integrated circuit that consists of an array of AND and OR gates whose operation can be modified by programming the PLD. In one preferred form, the PLD is programmed by blowing fuses internal to the PLD.

In accordance with a further aspect of the present exemplary embodiment, the PLD is a one of a programmable read only memory (PROM), and programmable logic array (PLA) and a programmable array logic/generic array logic (PAL/GAL) and the like.

In accordance with yet a further aspect of the present exemplary embodiments, the programmable logic device is a field programmable gate array (FPGA).

In accordance with yet further aspects of the present exemplary embodiments, the replaceable consumable is an ink cartridge holding ink.

In accordance with a yet further aspect, a replaceable consumable is a toner cartridge holding toner material.

BRIEF DESCRIPTION OF THE DRAWINGS

The invention may take form in certain components, structures, and steps, the preferred of which will be illustrated in the accompanying drawings.

DETAILED DESCRIPTION OF THE PREFERRED EMBODIMENTS

Figure 1:
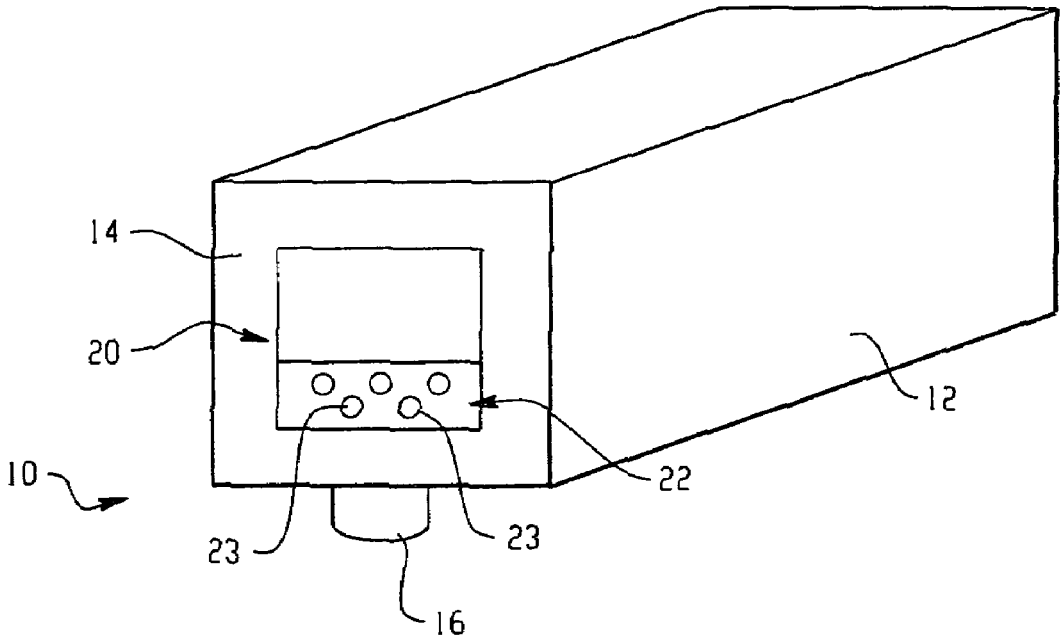
FIG. 1 is a schematic diagram of a replaceable consumable with a configurable processor in accordance with a preferred embodiment of the application.

Turning first to FIG. 1, a replaceable consumable 10 is shown in schematic form and illustrating the preferred embodiment of the present application. As illustrated, the consumable 10 includes a housing 12 defining a chamber therein for storing a marking material. In accordance with one aspect of the present application, the marking material is ink. In accordance with a further aspect, the marking material is toner. Other marking materials are also contemplated within the spirit and scope of the present application. Further, materials other than those used for marking can be held in the housing 12 as well such as, for example, chemicals used in chemical treatment or process plants and other liquids, fluids, or flowing solids including edible substances.

The housing 12 includes a front face wall 14 and a bottom outlet port 16 adapted to conduct a flow of the consumable marking material contained within the cartridge body therethrough. Those skilled in the art will appreciate that the outlet port 16 includes o-rings, valves, or other mechanisms to provide a tight fluid connection between the associated printer (not shown) and the cartridge body to prevent spillage of the marking material.

The front face wall 14 of the housing 12 includes an electronic circuit 20 carried thereon. The electronic circuit 20 includes communication circuit portion 22 for establishing a communication link between the circuit 20 and the associated marking device such as a printer or the like. The communication circuit portion 22 can use any known technologies such as electromechanical contact pads 23, infrared transmitters and receivers, and radio frequency devices.

Figure 2:
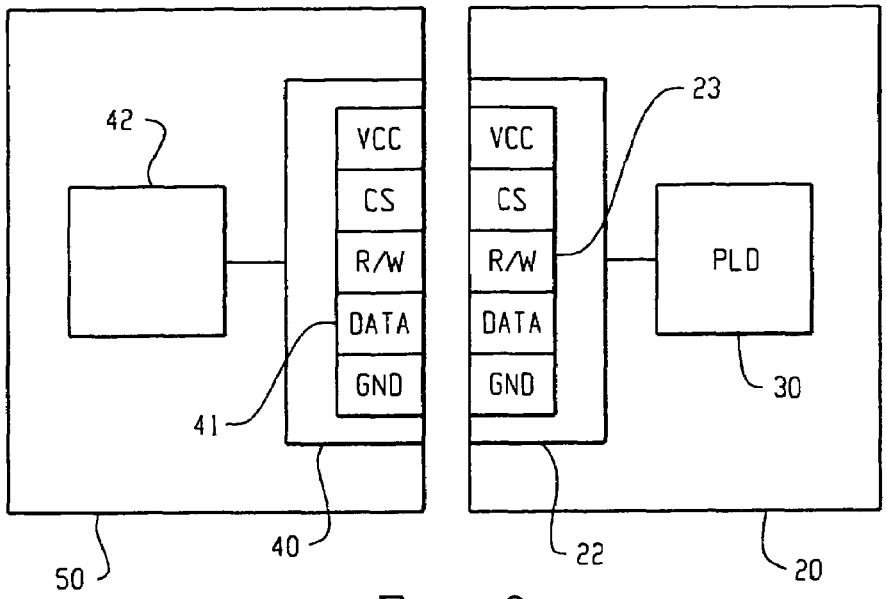
FIG. 2 is a schematic diagram of an electrical connection between an associated printer and the consumable of FIG. 1.

As shown in FIG. 2, the preferred form of the subject electronic circuit 20 includes a programmable logic device 30 connected with the communication circuit portion 20 for interfacing with a corresponding communication circuit 40 including a set of electrical contacts 41 carried on the associated marking device 50. As shown, the marking device 50 includes a central processor 42 adapted to execute a program stored therein to interrogate the programmable logic device 30 of the electronic circuit 20 carried on the consumable 10. To that end, the central processor 42 is in operative communication with the set of communication circuits 40 using an intermediary electrical connection 44 to control voltage and logic levels on various contact pad portions of the set of electrical contacts 41. A chip select logic signal is provided by a CS contact pad. Read and write control is provided by the R/W contact pad. Data is provided at the DATA pad. Lastly, voltage is established for powering the associated electronic circuit 20 using a pair of voltage and ground pads, namely VCC and GND.

The set of electrical contacts 23 carried on the electronic circuit 20 matches those of the marking device 50. In accordance with the preferred embodiment, the programmable logic device 30 is in operative electrical communication with the communication circuit portion 22 through an intermediary electrical connection 24. Essentially, in its preferred form, the programmable logic device 30 responds to signals generated by the central processor 42 of the marking device 50 to provide the necessary data and information for proper operation of the marking device 50.

Preferably, the subject programmable logic device includes an array of AND and OR gates which are programmable by fusing and/or diffusing selected interconnections therebetween as understood by those skilled in the art. In its preferred form, the programmable logic device is a simple PLD and, therefore, is programmed via a feasible link, antifuse, EPROM, EEPROM, or FLASH. Alternatively, the subject PLD can be a complex PLD formed by a number of simple PLDs connected together by a programmable switching matrix. In that embodiment, the complex PLD is a one of an EEPROM, FLASH, and SRAM based technology.

Figure 3:
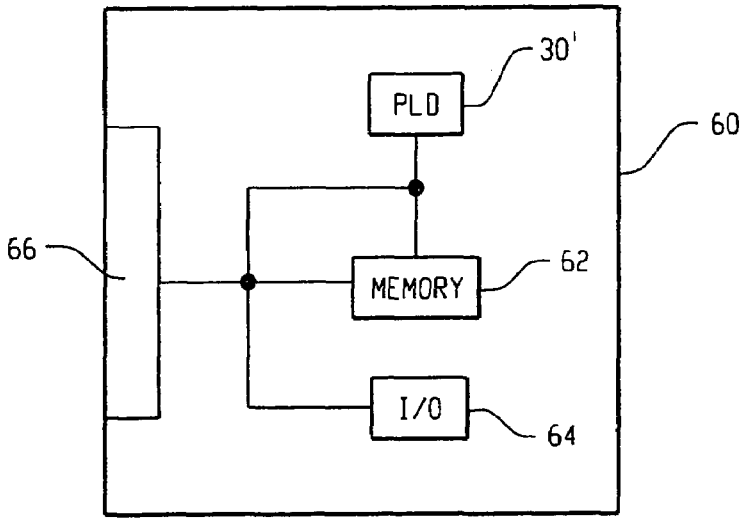
FIG. 3 is a schematic diagram showing an alternative programmable device for use on a replaceable consumable.

FIG. 3 shows an alternative embodiment of the electronic circuit shown in FIG. 2. To that end, as illustrated in FIG. 3, an electronic circuit 60 includes a programmable logic device 30' in operative communication with a data storage memory 62 and an input and output buffer circuit 64. The input/output buffer circuit 64 is operatively connected with a communication circuit 66 adapted for operative communication with a corresponding circuit 40 at the marking device 50. In the embodiment illustrated in FIG. 3, the programmable logic device includes an array of AND and OR gates which are programmable by fusing various links therebetween. The data memory 62 is used to store various information such as ink volume which can be updated by the marking device as necessary during operation thereof. An input and output circuit 64 is used to buffer the data and signals between the electronic circuit 60 and the associated marking device 50.

Figure 4:
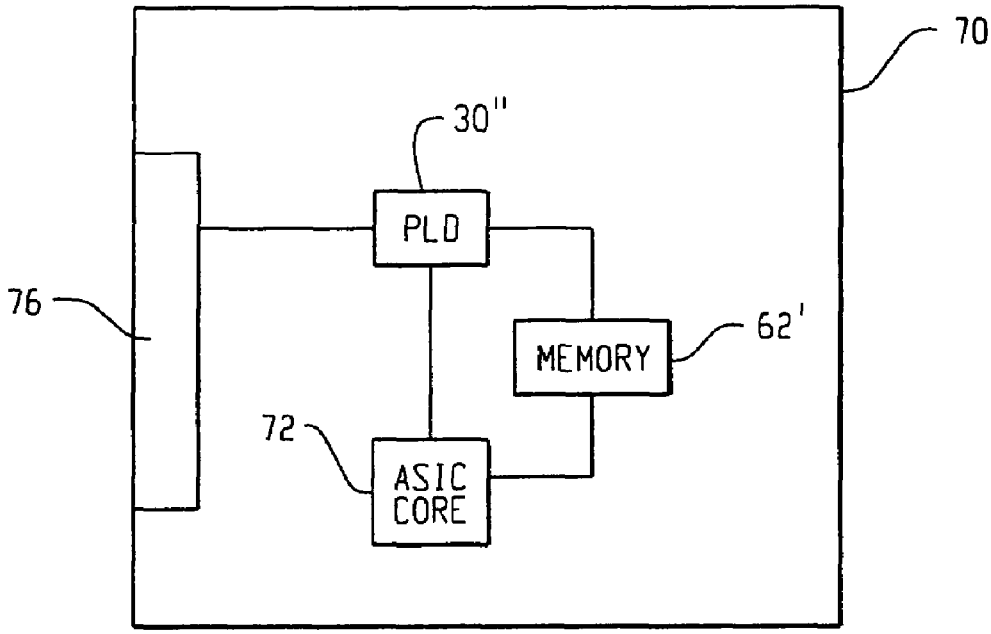
FIG. 4 is a further alternative embodiment of a configurable processor for use on a replaceable consumable.

FIG. 4 is a schematic diagram of yet a further embodiment of an electronic circuit 70 of the present application. As shown there, a programmable logic device 30" is in operative communication with a memory array 62' and an application specific integrated circuit core 72. In this embodiment, the ASIC core provides all of the fundamental operations of the circuit 70. However, additional functionality is provided by the programmable logic device 30" as may be deemed necessary during normal evolution of the product life span of the consumable 10. In essence, the ASIC functionality is augmented, modified, and improved during product life span by reconfiguring the PLD portion 30" of the electronic circuit 70. A communication circuit 76 is adapted for operative communication with a corresponding circuit 40 provided at the marking device 50.

Figure 5:
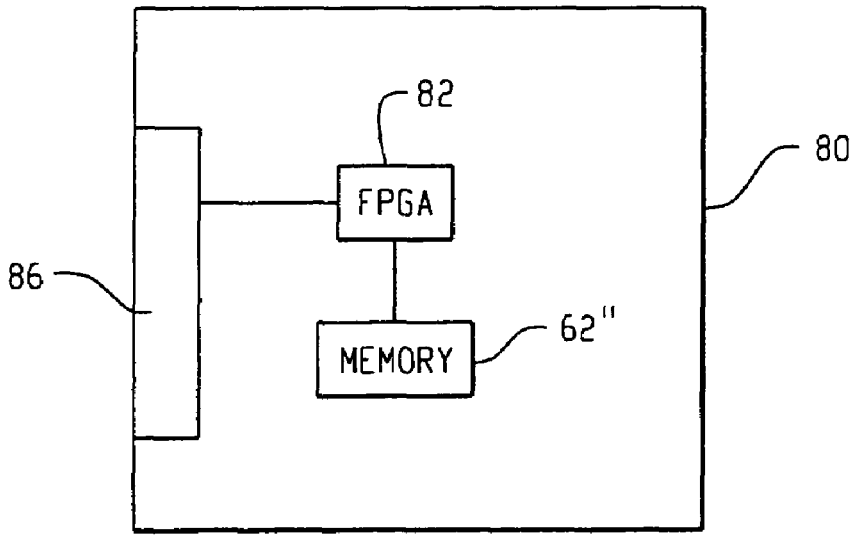
FIG. 5 is a further embodiment of a configurable processor for use on a replaceable consumable.

Turning lastly to FIG. 5, a yet further alternative embodiment of an electronic circuit 80 is shown in diagrammatical form. There, a field programmable gate array FGPA 82 is provided on the electronic circuit 80 in operative communication with a memory cell array 62". The memory cell array includes information relative to the marking material contained within the housing 12 such as, for example, ink quantity, type, color, and the like. The field programmable gate array includes a vast array of logical gates which are programmable via fusing in order to establish desired function behavior of the circuit relative to the marking device 50. A communication circuit 86 is included for operative communication with a corresponding circuit 40 at the marking device 50.

It is also understood and appreciated that the number of electrical contacts that are being used on the connection between the marking device and the above embodiments are not limited to five as shown in FIG. 2 for example. It can be any number of contacts that are required to provide a proper and cost effective interface between the marking device and the electronic circuit.

It is also understood and appreciated that the interface between the marking device and the electronics circuit can also be Radio Frequency (RF) instead of a direct contacting interface.

Figure 6:
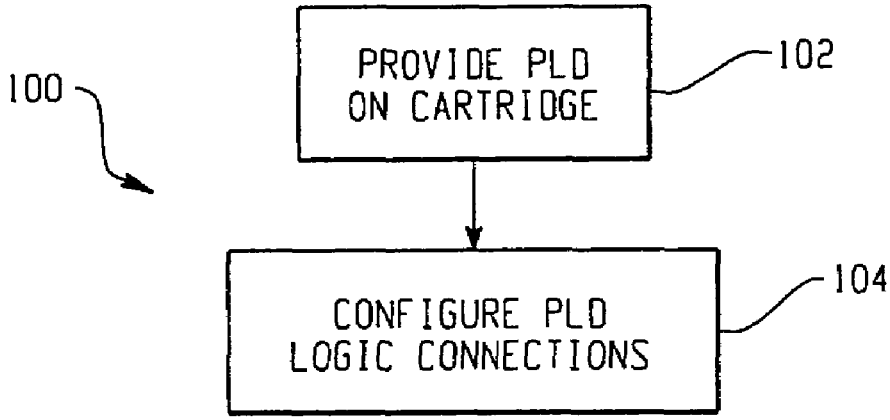
FIG. 6 is a flowchart illustrating a method of adapting a print cartridge for use with a printer in accordance with a preferred embodiment of the application; and, FIG. 7 is a flowchart illustrating a method of adapting a print cartridge including an application specific integrated circuit for use with a printer in accordance with a further preferred embodiment of the application.

FIG. 6 shows a method 100 of adapting a print cartridge for use with a printer in accordance with a further preferred embodiment of the present application. With reference now to that figure, a processor is provided 102 on a first print cartridge. The processor is preferably a programmable logic device having configurable internal logic as described above. Thereafter, the processor is configured 104 so that it is operable with an associated printing device making the cartridge interoperable with the printing device. Preferably, the configuring at step 104 includes opening fusible links between logical AND and OR gates in the PLD device.

Figure 7:
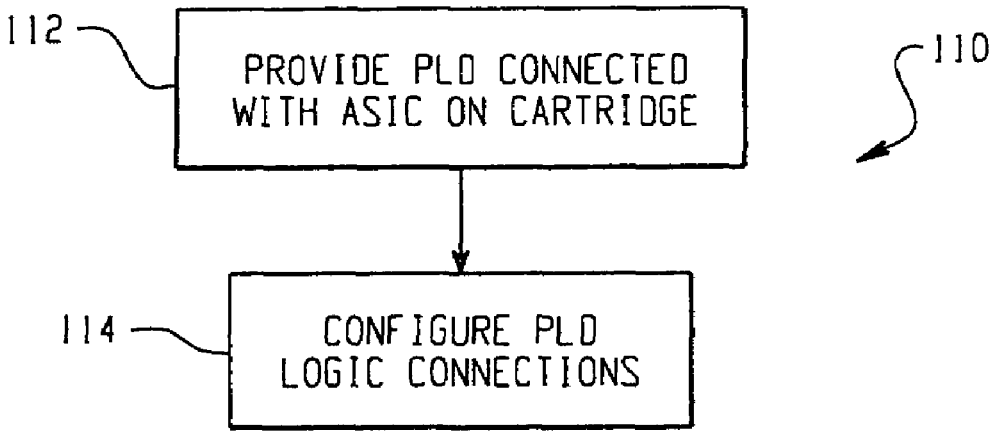

FIG. 7 shows an alternative preferred embodiment of a method 110 for adapting a print cartridge for use with a printer in accordance with the application. Initially, at step 112, a processor is provided connected with an application specific integrated circuit ASIC on a cartridge in a manner substantially as described above in connection with FIG. 4. Preferably, the processor has configurable logic and includes a programmable logic device PLD. The PLD is connected together with an ASIC on a cartridge. Thereafter, at step 114, the logic within the processor is configured for adapting the ASIC and overall cartridge for use with the associated printing device. Preferably, the configuring includes opening fusible links between logical AND and OR gates in the programmable logic device.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A replaceable consumable print cartridge for supplying a marking material to an associated printing device, the replaceable consumable comprising:

a housing defining a chamber for storing a marking material therein; and, a circuit on the housing, the circuit including:

a memory portion storing data related to the marking material;

an interface portion in operative communication with the associated printing device to communicate said data relating to the marking material between the associated printing device and the circuit; and, a configurable execution unit including:

an application specific integrated (ASIC); and a programmable logic device (PLD) connected with said ASIC and programmable for operative communication with said associated printing device.

2. The print cartridge according to claim 1 wherein said PLD is programmable by opening fusible links between logical gates in said programmable logic device.

3. The print cartridge according to claim 1 wherein the housing defines a chamber for storing ink.

4. The print cartridge according to claim 1 wherein the housing defines a chamber for storing toner therein.

5. The print cartridge according to claim 1 wherein the configurable execution unit is field programmable.

6. The print cartridge according to claim 1 wherein:

the interface portion is a one of an electromechanical contact system, an electromagnetic system, a radio frequency (RF) communication system, and an infra-red system.

7. A method of adapting a first print cartridge for use with a first printer comprising:

providing a processor having configurable logic on the first print cartridge, the processor including:

an ASIC, and a programmable logic device connected with said ASIC; and, configuring said configurable logic of said processor for operative compatibility with said first printer by opening fusible links between logical gates in said programmable logic device.

8. A print cartridge for use with an associated printing device, the print cartridge comprising:

a housing holding a marking material therein; and, a processor on the housing, said processor comprising:

internal configurable logic components, and an application specific integrated (ASIC) connected with said internal configurable logic components;

wherein said internal configurable logic components include an array of logical gates configured for operative communication with said associated printing device.

9. The print cartridge according to claim 8 wherein:

said array of logical gates are configured by opening fusible links between said logical gates.

10. The print cartridge according to claim 8 wherein:

said array of logical gates are field programmable.

* * * * *